US008597502B2

(12) United States Patent
Tanaka et al.

(10) Patent No.: US 8,597,502 B2
(45) Date of Patent: Dec. 3, 2013

(54) METHOD OF MANUFACTURING DIESEL FUEL BASE STOCK AND DIESEL FUEL BASE STOCK THEREOF

(75) Inventors: Yuichi Tanaka, Yokohama (JP); Kazuhito Sato, Kitakatsushika-gun (JP)

(73) Assignees: Japan Oil, Gas and Metals National Corporation, Kanagawa (JP); Inpex Corporation, Tokyo (JP); Nippon Oil Corporation, Tokyo (JP); Japan Petroleum Exploration Co., Ltd., Tokyo (JP); Cosmo Oil Co., Ltd., Tokyo (JP); Nippon Steel Engineering Co., Ltd., Tokyo (JP)

( * ) Notice: Subject to any disclaimer, the term of this patent is extended or adjusted under 35 U.S.C. 154(b) by 0 days.

(21) Appl. No.: 12/733,918

(22) PCT Filed: Sep. 25, 2008

(86) PCT No.: PCT/JP2008/067284

§ 371 (c)(1),
(2), (4) Date: Apr. 28, 2010

(87) PCT Pub. No.: WO2009/041487

PCT Pub. Date: Apr. 2, 2009

(65) Prior Publication Data

US 2010/0294696 A1 Nov. 25, 2010

(30) Foreign Application Priority Data

Sep. 28, 2007 (JP) ..... 2007-256544

(51) Int. Cl.
*C10G 55/04* (2006.01)
*C10G 65/00* (2006.01)

(52) U.S. Cl.
USPC ..... 208/308; 208/15; 208/89; 208/106; 208/133; 208/950

(58) Field of Classification Search
USPC ..... 208/15, 24, 950
See application file for complete search history.

(56) References Cited

U.S. PATENT DOCUMENTS 6,589,415 B2 7/2003 Smith et al.
(Continued)

FOREIGN PATENT DOCUMENTS

CA 1339640 C 1/1998
(Continued)

OTHER PUBLICATIONS

Canadian Office Action dated Dec. 9, 2011, issued in corresponding Canadian Application No. 2,700,090.
(Continued)

*Primary Examiner* — Ellen McAvoy
(74) *Attorney, Agent, or Firm* — Kenyon & Kenyon LLP

(57) ABSTRACT

Disclosed is a method of manufacturing a diesel fuel base stock improved in low-temperature flowability, including: fractionating in a first fractionator a synthetic oil obtained by Fisher-Tropsch synthesis into at least two fractions of a first middle fraction containing a component having a boiling range corresponding to diesel fuel oil, and a wax fraction containing a wax component heavier than the first middle fraction; hydroisomerizing the first middle fraction by bringing the first middle fraction into contact with a hydroisomerizing catalyst to produce a hydroisomerized middle fraction; hydrocracking the wax fraction by bringing the wax fraction into contact with a hydrocracking catalyst to produce a wax-decomposition component; and fractionating in a second fractionator a mixture of the produced hydroisomerized middle fraction and the produced wax-decomposition component, wherein rectification conditions in the first fractionator and/or rectification conditions in the second fractionator are adjusted to selectively reduce an n-paraffin having 19 or more carbon atoms in a heavy component contained in the diesel fuel base stock. Furthermore, disclosed is a diesel fuel base stock obtained by the manufacturing method.

3 Claims, 1 Drawing Sheet

(56) References Cited

U.S. PATENT DOCUMENTS

| | | | | |
|---|---|---|---|---|
| 6,656,342 | B2 | 12/2003 | Smith et al. | |
| 7,345,211 | B2 * | 3/2008 | Espinoza et al. | 585/14 |
| 7,655,136 | B2 | 2/2010 | Euzen et al. | |
| 7,704,378 | B2 * | 4/2010 | Benazzi et al. | 208/108 |
| 2002/0146358 | A1 | 10/2002 | Smith et al. | |
| 2003/0057134 | A1 | 3/2003 | Benazzi et al. | |
| 2004/0159582 | A1 * | 8/2004 | Simmons et al. | 208/89 |
| 2006/0016722 | A1 * | 1/2006 | Espinoza et al. | 208/14 |
| 2006/0219597 | A1 * | 10/2006 | Bishop et al. | 208/15 |

FOREIGN PATENT DOCUMENTS

| | | |
|---|---|---|
| CN | 1295117 | 5/2001 |
| FR | 2887556 | 12/2006 |
| JP | 2004-526034 | 8/2004 |
| JP | 2004-526035 | 8/2004 |
| JP | 2004-269686 | 9/2004 |
| JP | 2004-323626 | 11/2004 |
| JP | 2007-238870 | 9/2007 |
| WO | 00/20534 | 4/2000 |
| WO | 2005/091815 | 10/2005 |
| WO | 2006/067174 | 6/2006 |
| WO | 2006/069990 | 7/2006 |
| WO | 2007/105400 | 9/2007 |
| WO | WO 2007/113967 | 10/2007 |

OTHER PUBLICATIONS

Iraqi Office Action dated Apr. 26, 2012, issued in corresponding Iraqi Application No. 236/2008.

Wikipedia, the Free Encyclopedia, "Fischer-Tropsch process", May 13, 2012, http://en.wikipedia.org/wiki/Fischer%E2%80%93Tropsch_process.

Japanese Office Action, dated Aug. 14, 2012, issued in corresponding Japanese Application No. 2009-534352, and an English translation thereof.

Chinese Office Action, dated Aug. 21, 2012, issued in corresponding Chinese Application No. 200880108572.4, and an English translation thereof.

Japanese Notice of Allowance, dated Nov. 13, 2012, issued in corresponding Japanese Application No. 2009-534352, and an English translation thereof.

International Search Report dated Dec. 22, 2008 issued in corresponding PCT Application No. PCT/JP2008/067284.

European Search Report dated Jul. 4, 2013, issued in corresponding European Application No. 08832836.4.

* cited by examiner

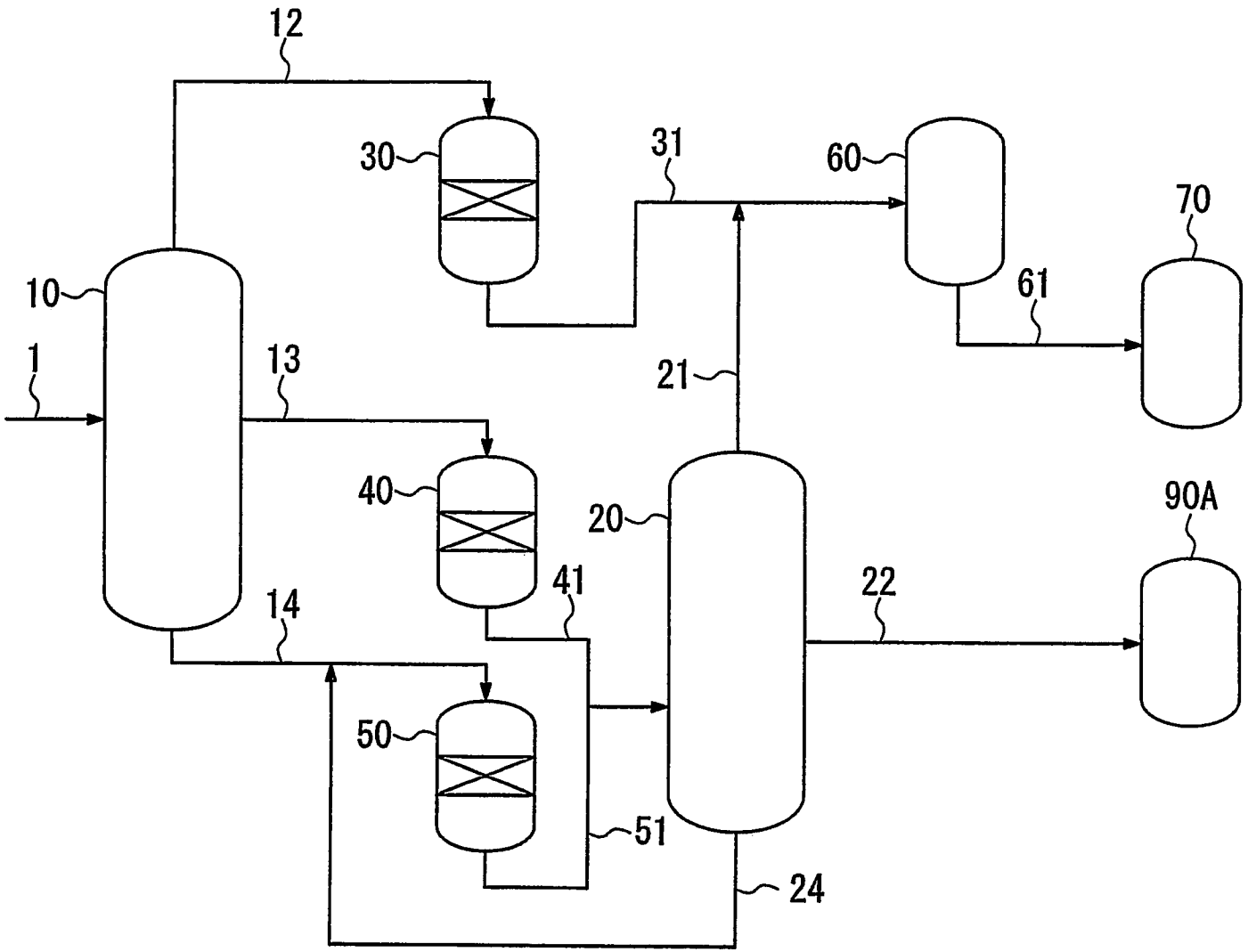
70
90A
61
60
22
24
31
21
20
51
41
30
40
50
12
13
14
10
1

METHOD OF MANUFACTURING DIESEL FUEL BASE STOCK AND DIESEL FUEL BASE STOCK THEREOF

TECHNICAL FIELD

This application is a national stage application of International Application No. PCT/JP2008/067284, filed 25 Sep. 2008, which claims priority to Japanese Application No. 2007-256544, filed 28 Sep. 2007, which is incorporated by reference in its entirety.

The present invention relates to a method of manufacturing a diesel fuel base stock from synthetic oil obtained by a Fisher-Tropsch synthesis method, and a diesel fuel base stock thereof.

BACKGROUND ART

In recent years, from the standpoint of reduction of environmental burdens, there has been a need for a clean liquid fuel which has a low content of sulfur and aromatic hydrocarbons and is compatible with the environment. Thus, in the oil industry, a Fisher-Tropsch synthesis method (hereinafter abbreviated as "FT synthesis method) using carbon monoxide and hydrogen as raw materials has been investigated as a method of manufacturing a clean fuel. The FT synthesis method has high expectations since it can manufacture a liquid fuel base stock which has an abundance of paraffin and which does not contain sulfur, for example, a diesel fuel base stock. For example, Patent Document 1 discloses a fuel oil compatible with the environment.

Patent Document 1: Japanese Unexamined Patent Application, Publication No. 2004-323626

A synthetic oil obtained by the FT synthesis method (hereinafter may be referred to as "FT synthetic oil") has a broad carbon number distribution. From the FT synthetic oil, it is possible to obtain an FT naphtha fraction containing a number of hydrocarbons having a boiling point of, for example, 150° C. or less, an FT middle fraction containing a number of hydrocarbons having a boiling point of 150° C. to 360° C., and an FT wax fraction heavier than the FT middle fraction.

There is a concern that the FT middle fraction has insufficient low temperature-performance if the fraction is not processed because the FT middle fraction contains a great quantity of n-paraffins.

Furthermore, a substantial quantity of the FT wax fraction is simultaneously produced. Therefore, if such FT wax fraction can be converted to lighter products by way of hydrocracking the FT fraction, this will result in increased production of a diesel fuel.

Accordingly, the FT synthetic oil is fractionated into the FT middle fraction and the FT wax fraction, and the FT middle fraction is hydroisomerized to increase the iso-paraffin content in order to improve its low temperature performance.

On the other hand, the FT wax fraction is hydrocracked to convert the FT wax fraction to lighter products, thereby increasing the amount of the middle fraction. Accordingly, a sufficient quantity of a diesel fuel having sufficient performance can be obtained as the middle fraction from FT synthetic oil.

DISCLOSURE OF THE INVENTION

Problem that the Invention is to Solve

Based on the above-described grounds, while an isomerization reaction also proceeds in hydrocracking, the isomerization selectivity to light fractions contained in a hydrocracked raw material (i.e. wax component) is low. Accordingly, it is difficult to sufficiently improve low temperature performance of the decomposition product thereof.

In addition, because the low temperature performance of the diesel fuel base stock is easily affected by the low temperature performance of the decomposition product, the low temperature performance of the decomposition product needs to be improved.

Therefore, an object of the invention is to produce a great quantity of the diesel fuel base stock having excellent low temperature performance by increasing the amount of the produced diesel fuel base stock while also improving low temperature properties thereof.

Means for Solving the Problem

To accomplish the above object, a hydroisomerized product of the first middle fraction is provided as a diesel fuel base stock in the present invention, and a middle fraction-equivalent portion (wax-decomposition component), which is obtained by converting the wax fraction to lighter products using hydrocracking, is mixed into the first middle fraction, and the diesel fuel base stock is manufactured. In this case, n-paraffins are selectively reduced in a heavy portion of the produced diesel fuel base stock to improve low temperature properties of the diesel fuel base stock.

Specifically, the present invention relates to the following aspect.

(1) A method of manufacturing a diesel fuel base stock improved in low-temperature flowability, including: fractionating in a first fractionator a synthetic oil obtained by Fisher-Tropsch synthesis into at least two fractions of a first middle fraction containing a component having a boiling range corresponding to diesel fuel oil, and a wax fraction containing a wax component heavier than the first middle fraction; hydroisomerizing the first middle fraction by bringing the first middle fraction into contact with a hydroisomerizing catalyst to produce a hydroisomerized middle fraction; hydrocracking the wax fraction by bringing the wax fraction into contact with a hydrocracking catalyst to produce a wax-decomposition component; and fractionating in a second fractionator a mixture of the produced hydroisomerized middle fraction and the produced wax-decomposition component, wherein rectification conditions in the first fractionator and/or rectification conditions in the second fractionator are adjusted to selectively reduce an n-paraffin having 19 or more carbon atoms in a heavy component contained in the diesel fuel base stock.

(2) The method of manufacturing a diesel fuel base stock according to (1), wherein the fractionation is conducted where the 90% by volume distillation temperature of the first middle fraction, which is a feedstock for the hydroisomerization, is higher than the 90% by volume distillation temperature of the diesel fuel base stock by 20° C. or more as one of the rectification conditions in the first fractionator.

(3) The method of manufacturing a diesel fuel base stock according to (1) or (2), wherein the 90% by volume distillation temperature of the first middle fraction, which is a feedstock for the hydroisomerization, is 360° C. or higher, and the 90% by volume distillation temperature of the diesel fuel base stock is 340° C. or less.

(4) The method of manufacturing a diesel fuel base stock according to any one of (1) to (3), wherein, when bringing the first middle fraction into contact with the hydroisomerizing catalyst, the reaction temperature is 180° C. to 400° C., the hydrogen partial pressure is 0.5 MPa to 12 MPa, and the liquid hourly space velocity is 0.1 $h^{-1}$ to 10.0 $h^{-1}$; and, when bringing the wax fraction into contact with the hydrocracking catalyst, the reaction temperature is 180° C. to 400° C., the hydrogen partial pressure is 0.5 MPa to 12 MPa, and the liquid hourly space velocity is 0.1 $h^{-1}$ to 10.0 $h^{-1}$.

(5) A diesel fuel base stock obtained by the method according to any one of (1) to (4), having a pour point of −7.5° C. or less and kinematic viscosity at 30° C. of 2.5 $mm^2/s$ or higher.

Advantage of the Invention

According to the present invention, it is possible to achieve increased production in manufacturing a diesel fuel base stock from FT synthetic oil while excellent low temperature properties can be achieved.

BRIEF DESCRIPTION OF THE DRAWINGS

FIG. 1 is a schematic diagram showing one embodiment of a plant for manufacturing a diesel fuel base stock according to the invention. The manufacturing plant includes a first fractionator 10 wherein FT synthetic oil is fractionated; and a hydro-refining apparatus 30, a hydroisomerizing apparatus 40 and a hydrocracking apparatus 50 where a naphtha fraction, a middle fraction and a wax fraction fractionated in the first fractionator 10 are treated.

DESCRIPTION OF REFERENCE NUMERALS

10: FIRST FRACTIONATOR WHEREIN FT SYNTHETIC OIL IS FRACTIONATED
20: SECOND FRACTIONATOR WHEREIN PRODUCTS SUPPLIED FROM THE HYDROISOMERIZING APPARATUS 40 AND THE HYDROCRACKING APPARATUS 50 ARE FRACTIONATED
30: HYDRO-REFINING APPARATUS FOR THE NAPHTHA FRACTION FRACTIONATED IN THE FIRST FRACTIONATOR 10
40: HYDROISOMERIZING APPARATUS FOR THE FIRST MIDDLE FRACTION FRACTIONATED IN THE FIRST FRACTIONATOR 10
50: HYDRO-CRACKING APPARATUS FOR THE WAX FRACTION FRACTIONATED IN THE FIRST FRACTIONATOR 10
60: STABILIZER WHERE LIGHT GAS OF A PRODUCT IN THE HYDRO-REFINING APPARATUS 30 IS EXTRACTED FROM THE TOWER APEX
70: NAPHTHA STORAGE TANK
90A: DIESEL FUEL BASE STOCK STORAGE TANK.

BEST MODE FOR CARRYING OUT THE INVENTION

Hereinafter, the present invention will be described with regard to a preferred embodiment of a plant used for the method of manufacturing a diesel fuel base stock according to the present invention with reference to FIG. 1.

The plant for manufacturing a diesel fuel base stock shown in FIG. 1 includes a first fractionator 10 wherein FT synthetic oil is fractionated; and a hydro-refining apparatus 30, a hydroisomerizing apparatus 40 and a hydrocracking apparatus 50 which are apparatuses for treating a naphtha fraction, a middle fraction and a wax fraction fractionated in the first fractionator 10.

The naphtha fraction delivered from the hydrofining apparatus 30 passes through a stabilizer 60 and a line 61, and is stored in a naphtha storage tank 70 as naphtha.

The treated products from the hydroisomerizing apparatus 40 and the hydrocracking apparatus 50 are mixed, and then, the mixture is introduced into a second fractionator 20, and the second fractionator 20 extracts a second middle fraction, which is to be used as a diesel fuel base stock, into a tank 90A through a line 22. In the embodiment shown in FIG. 1, the number of second middle fractions is one. However, the second middle fraction may be fractionated into a plurality of fractions including, for example, a kerosene fraction, a gas oil fraction, etc.

In addition, the bottom fraction in the second fractionator 20 is delivered back to a line 14 prior to the hydrocracking apparatus 50 through a line 24, and the bottom fraction is recycled and hydrocracked therein. In addition, a light tower apex fraction in the second fractionator 20 is delivered back to a line 31 prior to the stabilizer 60 through a line 21 and is introduced into the stabilizer 60.

In the first fractionator 10, the FT synthetic oil may be fractionated into three fractions of a naphtha fraction, a kerosene-gas oil fraction and a wax fraction which may be separated by boiling points of, for example, 150° C. and 360° C. A line 1 for introducing the FT synthetic oil, and lines 12, 13 and 14 for delivering fractionated distillates (fractions) to the apparatuses are connected to the first fractionator 10. More specifically, the line 12 is a line that delivers a naphtha fraction fractionated under a condition of 150° C. or less; the line 13 is a line that delivers a middle fraction fractionated under a condition of 150° C. to 360° C.; and the line 14 is a line that delivers a wax fraction fractionated under a condition of more than 360° C. In addition, when the FT synthetic oil is fractionated, a cut point for each fraction is appropriately selected in terms of yield of the targeted final product, etc.

(Fractionation of FT Synthetic Oil)

FT synthetic oil applied to the present invention is not particularly limited as long as the FT synthetic oil is produced by the FT synthesis method. However; it is preferable that the synthetic oil contain 80% by mass or more of a hydrocarbon having a boiling point of 150° C. or higher, and 35% by mass or more of a hydrocarbon having a boiling point of 360° C. or higher, based on the total amount of the FT synthetic oil. The total amount of FT synthetic oil means the sum of hydrocarbons having 5 or more carbon atoms which are produced by the FT synthesis method.

In the first fractionator 10, at least two cut points may be set to fractionate the FT synthetic oil. Consequently, a fraction of less than the first cut point is obtained as a naphtha light fraction through the line 12; a fraction of the first cut point to the second cut point is obtained as a middle fraction corresponding to a gas oil fraction through the line 13; and a fraction of more than the second cut point is obtained as tower bottom oil (heavy wax component) corresponding to a wax fraction through the line 14.

Additionally, with regard to the pressure inside the first fractionator 10, distillation may be carried out under reduced pressure or normal pressure. However, distillation under normal pressure is general.

The naphtha fraction is sent to the hydro-refining apparatus 30 through the line 12 which is connected to the tower apex of the first fractionator 10, and the naphtha fraction is hydrotreated in the hydro-refining apparatus 30.

The middle fraction of the kerosene-gas oil fraction is sent to the hydroisomerizing apparatus 40 through the line 13 of the first fractionator 10, and the middle fraction is subjected to hydroisomerization in the hydroisomerizing apparatus 40.

The wax fraction is extracted through the bottom line 14 of the first fractionator 10, and then is delivered to the hydrocracking apparatus 50 where the wax fraction is subjected to hydrocracking.

The naphtha fraction extracted through the line 12 connected to the apex of the first fractionator 10 is so-called naphtha, which may be used as a petrochemical raw material or a gasoline base stock.

Compared to naphtha produced from crude oil, the naphtha fraction obtained from the FT synthetic oil includes relatively large amounts of olefins and alcohols. Accordingly, it is difficult to use such naphtha fraction in the same manner as generally-called "naphtha". In addition, the lighter the fraction in the FT synthetic oil is, the higher content of olefins and alcohols the fraction has. Consequently, the content of olefins and alcohols in the naphtha fraction is the highest while the content in the wax fraction is the lowest among fractions.

Based on the above-described grounds, in the hydro-refining apparatus 30, olefins are hydrogenated by hydrogen treatment to convert the olefins into paraffins, and alcohols are subjected to hydrogen treatment to remove a hydroxyl group whereby the alcohols are also converted into paraffins. In addition, as long as the treated naphtha fraction is utilized for general naphtha use, it is unnecessary to conduct isomerization to convert n-paraffin into iso-paraffin, or decomposition of n-paraffins. That is, the naphtha fraction is delivered from the hydro-refining apparatus 30 to the stabilizer 60 through the line 31, light fractions such as gas are extracted from the top of the hydro-refining apparatus 30, and the naphtha fraction obtained from the bottom of the stabilizer 60 may be simply stored in the naphtha storage tank 70 through the line 61.

The kerosene-gas oil fraction, corresponding to the first middle fraction, which is extracted from the first fractionator 10 through the line 13 may be used, for example, as a diesel fuel base stock Since a substantial quantity of n-paraffins is contained in the first middle fraction obtained from the FT synthetic oil, low temperature properties (such as low-temperature flowability) of the first middle fraction may be insufficient. Therefore, the first middle fraction is hydroisomerized to improve the low temperature properties. If such hydroisomerization is performed, olefin hydrogenation and alcohol dehydroxylation can be simultaneously conducted in addition to isomerization. Since the middle fraction obtained by fractionating the FT synthetic oil may contain olefins or alcohols, hydroisomerization is preferably conducted. This is because olefins or alcohols can be converted into paraffins, and paraffins can be further converted into iso-paraffins.

In addition, hydrocracking may be simultaneously promoted depending on hydrogenation conditions. However, if hydrocracking is simultaneously promoted, the boiling point of the middle fraction will vary, or yield of the middle fraction will be lowered. Therefore, in the process of isomerizing the middle fraction, hydrocracking is preferably suppressed.

The wax fraction is extracted from the bottom line 14. The amount of wax fraction obtained by fractionating the FT synthetic oil is considerable. Therefore, the wax fraction can be decomposed to increase the middle fraction, and the increased middle fraction is at least recovered.

The wax decomposition refers to hydrocracking. Such hydrocracking is preferable since the reaction converts olefins or alcohols, which may be included in the wax fraction, into paraffins due to hydrogen addition.

In this case, the isomerization selectivity to light fraction contained in a hydrocracked raw material (i.e. wax component) is low. Accordingly, low temperature performance of the decomposition products would be insufficient.

In the meantime, as described above, since the low temperature performance of the diesel fuel base stock depends on the low temperature performance of the decomposition products (wax-decomposition component), the low temperature performance of the degradation products needs to be improved.

Therefore, in the present invention, it is preferable that the first middle fraction extracted from the first fractionator 10 through the line 13 be fractionated where the first middle fraction contains a light wax component (n-paraffins having 20 to 25 carbon atoms) having low isomerization selectivity if the light wax component is treated in the hydrocracking apparatus 50.

That is, the first middle fraction is subjected to "crude extraction" as a rectification condition. More specifically, the upper limit of the boiling range of the first middle fraction is not set to equal to the upper limit of the boiling range of the diesel fuel base stock obtained from the second fractionator, but may be set preferably to slightly higher than a boiling range required for the diesel fuel base stock. This is because, under such a condition, the first middle fraction can be fractionated such that a heavier portion is included in the first middle fraction.

With regard to more detailed rectification conditions in the first fractionator, fractionation may be conducted where the 90% by volume distillation temperature (T90) of the first middle fraction, which is a feedstock for the above-described hydroisomerization, is higher than T90 of the diesel fuel base stock by 20° C. or more as the rectification conditions in the first fractionator.

The above term "distillation 90% by volume distillation temperature (T90)" refers to a value obtained in accordance with JIS K2254 "Petroleum products-Determination of distillation characteristics."

For example, the middle fraction may be fractionated where T90 of the middle fraction, which is a feedstock of the hydroisomerization, is 360° C. or higher while T90 of the produced diesel fuel base stock becomes 340° C. or less. In other words, the middle fraction is fractionated where T90 of the middle fraction is higher than T90 of the diesel fuel base stock by 20° C. or higher.

The upper limit of T90 of the first middle fraction is not particularly limited. However, it is generally preferable that T90 of the first middle fraction be 380° C. or less because sufficient hydroisomerizing can be easily conducted to a heavy component in the middle fraction. Also, the lower limit of T90 of the diesel fuel base stock is not particularly limited. However, it is generally preferable that T90 of the diesel fuel base stock be 320° C. or higher because such a range can attain sufficient yield coefficient of the diesel fuel base stock and can prevent the value of kinematic viscosity, described below, from being excessively small.

As a result of the above-described fractionation according to the crude extraction, the wax fraction obtained from line 14 of the first fractionator does not substantially contain a light wax component (n-paraffins having 20 to 25 carbon atoms) having low isomerization selectivity in hydrocracking is not substantially included in the wax fraction obtained from the line 14 of the first fractionator, and the light wax component passes through the line 13, and the light wax component is isomerized in the hydroisomerizing apparatus 40. The diesel fuel base stock obtained in this way contains few n-paraffins having 20 to 25 carbon atoms, thereby improving low temperature properties of the resulting diesel fuel oil.

Additionally, the product treated in the hydroisomerizing apparatus 40 passes through a line 41, and is introduced into the second fractionator 20.

In the same manner, the product treated in the hydrocracking apparatus 50 passes through a line 51, and is introduced into the second fractionator 20.

The hydroisomerized product and the hydrocracked product are mixed. Then, the mixture is fractionated in the second fractionator. A light fraction is delivered to a naphtha fraction system through the line 21 while a second middle fraction is extracted through the line 22 as the diesel fuel base stock. As described earlier, the second middle fraction may be fractionated into a plurality of fractions, and the plurality of fractions may be extracted.

The method of mixing the hydroisomerized product and the hydrocracked product is not particularly limited. For example, tank blending or line blending may be adopted.

In addition, with regard to the pressure inside the second fractionator, distillation may be carried out under reduced pressure or normal pressure. However, distillation under normal pressure is general.

A bottom component of the second fractionator 20 is recycled from the line 24 previous to the hydrocracking apparatus 50 for the wax, and then is again hydrocracked in the hydrocracking apparatus 50 to increase a decomposition yield.

Here, a diesel fuel base stock is basically obtained in the second fractionator 20.

Thus, considering that the low temperature properties of the diesel fuel base stock depends on the heavy portion, with regard to fractionation in the second fractionator, it is required to increase the degree of fractionation so that the n-paraffins corresponding to the heavy portion (n-paraffins having 19 or more carbon atoms) is drained from the bottom of the second fractionator. If more n-paraffins are selectively drained from the bottom of the second fractionator 20, this contributes to an increase in decomposition yield due to recycling through the line 24. The degree of fractionation in the second fractionator may be improved according to any method known in the art. For example, increasing the number of rectification stages, selecting a tray enabling excellent rectification performance, or the like can be mentioned.

The diesel fuel base stock is extracted therefrom, or if the middle fraction is fractionated into a plurality of fractions, the fractions may be appropriately mixed. Then, the product is stored in the diesel fuel tank 90A for later use.

It is required for the diesel fuel base stock to have kinematic viscosity at 30° C. of a certain value or higher to prevent occurrence of a broken oil film while operating machinery. More specifically, the kinematic viscosity at 30° C. needs to be 2.5 $mm^2/s$ or more, and the upper limit is not particularly limited. However, it is preferable that the kinematic viscosity at 30° C. be 6.0 $mm^2/s$ or less. If the kinematic viscosity at 30° C. exceeds 6.0 $mm^2/s$, black smoke may be increased therein, and this is not preferred.

In addition, the diesel fuel base stock also requires sufficient low temperature properties, for example, a low pour point when the diesel fuel material is utilized in cold regions. Specifically, the pour point is preferably −7.5° C. or less. It is preferable that the pour point be as low as possible in terms of improvement in the low temperature performance of the diesel fuel base stock. Therefore, the lower limit of the pour point is not particularly limited. However, if the pour point is excessively low, the above-mentioned the value of kinematic viscosity at 30° C. may be excessively small. Consequently, it may be difficult to achieve sufficient startability of the engine, stable engine rotation while idling, sufficient durability of a fuel injection pump, among others, under hot conditions. Therefore, it is preferable that the pour point be, for example, −25° C. or higher if the diesel fuel base stock of the present invention is utilized under such high temperature. Furthermore, a diesel fuel base stock whose pour point is adjusted within a range of −25° C. to −7.5° C. can achieve high performance even in a region with drastic changes in temperature. Therefore, such a diesel fuel base stock is preferably used.

In addition, "kinematic viscosity at 30° C." refers to a value measured in accordance with JIS K2283 "Crude oil and petroleum products—Determination of kinematic viscosity and calculation of viscosity index from kinematic viscosity," and the term "pour point" refers to a value measured in accordance with JIS K2269 "Testing method for Pour Point and Cloud Point of Crude Oil and Petroleum Products."

Hereinafter, conditions for operating each reaction apparatus that manufactures the diesel fuel base stock will be described in more detail.

<Hydroisomerization of First Middle Fraction>

In the hydroisomerizing apparatus 40, the first middle fraction fractionated in the first fractionator is hydroisomerized. A known fixed-bed reactor may be used as the hydroisomerizing apparatus 40. In this embodiment of the present invention, the reactor, which is a fixed-bed flow reactor, is filled with a predetermined hydroisomerizing catalyst, and the first middle fraction obtained in the first fractionator 10 is hydroisomerized. As used herein, the hydroisomerization includes conversion of olefins into paraffins by hydrogen addition and conversion of alcohols into paraffins by dehydroxylation in addition to hydroisomerization of n-paraffins to iso-paraffin.

Examples of the hydroisomerizing catalyst include a carrier of a solid acid onto which an active metal belonging to Group VIII in the periodic table is loaded.

Preferable examples of such a carrier include a carrier containing one or more kinds of solid acids which are selected from amorphous metal oxides having heat resistance, such as silica alumina, silica zirconium oxide, or alumina-boria.

A mixture including the above-mentioned solid acid and a binder may be subjected to shaping, and the shaped mixture may be calcined to produce the catalyst carrier. The blend ratio of the solid acid therein is preferably within a range of 1% to 70% by mass, or more preferably within a range of 2% to 60% by mass with respect to the total amount of the carrier.

The binder is not particularly limited. However, the binder is preferably alumina, silica, silica alumina, titania, or magnesia, and is more preferably alumina. The blend ratio of the binder is preferably within a range of 30% to 99% by mass, or more preferably within a range of 40% to 98% by mass based on the total amount of the carrier.

The calcination temperature of the mixture is preferably within a range of 400° C. to 550° C., more preferably within a range of 470° C. to 530° C., or particularly preferably within a range of 490° C. to 530° C.

Examples of the group VIII metal include cobalt, nickel, rhodium, palladium, iridium, platinum and the like. In particular, metal selected from nickel, palladium and platinum is preferably used singularly or in combination of two or more kinds.

These kinds of metal may be loaded on the above-mentioned carrier according to a common method such as impregnation, ion exchange or the like. The total amount of the loaded metal is not particularly limited. However, the amount of the loaded metal is preferably within a range of 0.1% to 3.0% by mass with respect to the carrier.

The hydroisomerization of the middle fraction may be performed under the following reaction conditions. The hydrogen partial pressure may be within a range of 0.5 MPa to 12 MPa, or preferably within a range of 1.0 MPa to 5.0 MPa. Liquid hourly space velocity (LHSV) of the middle fraction may be within a range of 0.1 $h^{-1}$ to 10.0 $h^{-1}$, or preferably within a range of 0.3 $h^{-1}$ to 3.5 $h^{-1}$. The hydrogen/oil ratio is not particularly limited. However, the hydrogen/oil ratio may be within a range of 50 NL/L to 1000 NL/L, or preferably within a range of 70 NL/L to 800 NL/L.

In the present description, "LHSV (liquid hourly space velocity)" refers to a volume flow rate of feedstock per capacity of a catalyst bed filled with catalyst under standard conditions (25° C. and 101,325 Pa), and the unit "$h^{-1}$" represents the reciprocal of hours. "NL" being the unit of hydrogen capacity in the hydrogen/oil ratio represents hydrogen capacity (L) under normal conditions (0° C. and 101,325 Pa).

The reaction temperature for the hydroisomerization may be within a range of 180° C. to 400° C., preferably within a range of 200° C. to 370° C., more preferably within a range of 250° C. to 350° C., or particularly within a range of 280° C. to 350° C. If the reaction temperature exceeds 400° C., a side reaction wherein the middle fraction is decomposed into a light fraction may be promoted, whereby yield of the middle fraction will be lowered, but also the product may be colored, and use of the middle fraction as a fuel base stock may be limited. Therefore, such a temperature range may not be preferred. On the other hand, if the reaction temperature is less than 180° C., alcohols may be insufficiently removed, and remain therein. Therefore, such a temperature range ma not be preferred.

<Hydrocracking of Wax Fraction>

In the hydrocracking apparatus 50, the wax fraction obtained from the first fractionator 10 is hydrogen-treated and decomposed. A known fixed-bed reactor may be used as the hydrocracking apparatus 50. In this embodiment of the present invention, the reactor, which is a fixed-bed flow reactor, is filled with a predetermined hydrocracking catalyst, and the wax fraction, which is obtained in the first fractionator 10 by way of fractionation, is hydrocracked therein. Preferably, a heavy fraction extracted from the bottom of the second fractionator 20 is delivered back to the line 14 through the line 24, and the heavy fraction is hydrocracked in the hydrocracking apparatus 50 along with the wax fraction from the first fractionator 10.

Although a chemical reaction that involves decrease in molecular weight mainly proceeds in the hydrogen treatment of the wax fraction, such hydrogen treatment includes hydroisomerization.

Examples of the hydrocracking catalyst include a carrier of a solid acid onto which an active metal belonging to Group VIII in the periodic table is loaded.

Preferable examples of such a carrier include a carrier containing a crystalline zeolite such as ultra-stable Y type (USY) zeolite, HY zeolite, mordenite, or β-zeolite one; and at least one solid acid selected from amorphous metal oxides having heat resistance, such as silica alumina, silica zirconia or alumina boria. Moreover, it is preferable that the carrier be a carrier containing USY zeolite; and at least one solid acid selected from silica alumina, alumina boria, and silica zirconia. Furthermore, a carrier containing USY zeolite and silica alumina is more preferable.

USY zeolite is a Y-type zeolite that is ultra-stabilized by way of a hydrothermal treatment and/or acid treatment, and fine pores within a range of 20 Å to 100 Å are formed in addition to a micro porous structure, which is called micropores of 20 Å or less originally included in Y-type zeolite. When USY zeolite is used for the carrier of the hydrocracking catalyst, its average particle diameter is not particularly limited. However, the average particle diameter thereof is preferably 1.0 μm or less, or more preferably 0.5 μm or less. In USY zeolite, a molar ratio of silica/alumina (i.e. molar ratio of silica to alumina; hereinafter referred to as "silica/alumina ratio") is preferably within a range of 10 to 200, more preferably within a range of 15 to 100, and the most preferably within a range of 20 to 60.

It is preferable that the carrier include 0.1% to 80% by mass of a crystalline zeolite and 0.1% to 60% by mass of a heat-resistant amorphous metal oxide.

A mixture including the above-mentioned solid acid and a binder may be subjected to shaping, and the shaped mixture may be calcined to produce the catalyst carrier. The blend ratio of the solid acid therein is preferably within a range of 1% to 70% by mass, or more preferably within a range of 2% to 60% by mass with respect to the total amount of the carrier. If the carrier includes USY zeolite, the blend ratio of USY zeolite is preferably within a range of 0.1% to 10% by mass, or more preferably within a range of 0.5% to 5% by mass to the total amount of the carrier. If the carrier includes USY zeolite and alumina-boria, the mixing ratio of USY zeolite to alumina-boria (USY zeolite/alumina-boria) is preferably within a range of 0.03 to 1 based on a mass ratio. If the carrier includes USY zeolite and silica alumina, the mixing ratio of USY zeolite to silica alumina (USY zeolite/silica alumina) is preferably within a range of 0.03 to 1 based on a mass ratio.

The binder is not particularly limited. However, the binder is preferably alumina, silica, silica alumina, titania, or magnesia, and is more preferably alumina. The blend ratio of the binder is preferably within a range of 20% to 98% by mass, or more preferably within a range of 30% to 96% by mass based on the total amount of the carrier.

The calcination temperature of the mixture is preferably within a range of 400° C. to 550° C., more preferably within a range of 470° C. to 530° C., or particularly preferably within a range of 490° C. to 530° C.

Examples of the group VIII metal include cobalt, nickel, rhodium, palladium, iridium, platinum and the like. In particular, metal selected from nickel, palladium and platinum is preferably used singularly or in combination of two or more kinds.

These kinds of metal may be loaded on the above-mentioned carrier according to a common method such as impregnation, ion exchange or the like. The total amount of the loaded metal is not particularly limited. However, the amount of the loaded metal is preferably within a range of 0.1% to 3.0% by mass with respect to the carrier.

Hydrocracking the wax fraction may be performed under the following reaction conditions. That is, the hydrogen partial pressure may be within a range of 0.5 MPa to 12 MPa, or preferably within a range of 1.0 MPa to 5.0 MPa. Liquid hourly space velocity (LHSV) of the middle fraction may be within a range of 0.1 $h^{-1}$ to 10.0 $h^{-1}$, or preferably within a range of 0.3 $h^{-1}$ to 3.5 $h^{1}$. The hydrogen/oil ratio is not particularly limited, but may be within a range of 50 NL/L to 1000 NL/L, preferably within a range of 70 NL/L to 800 NL/L.

The reaction temperature for hydrocracking may be within a range of 180° C. to 400° C., preferably within a range of 200° C. to 370° C., more preferably within a range of 250° C. to 350° C., particularly preferably 280° C. to 350° C. If the reaction temperature exceeds 400° C., a side reaction wherein the wax fraction is decomposed into a light fraction may be promoted, thereby decreasing yield of the wax fraction, and the product may be colored, thereby limiting use of the wax fraction as a fuel base stock. Therefore, such a temperature range is not preferred. If the reaction temperature is less than 180° C., alcohols may be insufficiently removed, and may be remain therein. Therefore, such a temperature range is not preferred.

According to the method of the present invention, a diesel fuel base stock preferably having a pour point of −7.5° C. or less and a kinematic viscosity at 30° C. of 2.5 $mm^2/s$ or higher may be produced.

EXAMPLES

Hereinafter, the present invention will be described in more detail with reference to Examples. However, the present invention is not limited to Examples.

<Preparation of Catalyst>

(Catalyst A)

Silica alumina (molar ratio of silica/alumina:14), and an alumina binder were mixed and kneaded at a weight ratio of 60:40, and the mixture was shaped into a cylindrical form having a diameter of about 1.6 mm and a length of about 4 mm. Then, this was calcined at 500° C. for one hour, thereby producing a carrier. The carrier was impregnated with a chloroplatinic acid aqueous solution to distribute platinum on the carrier. The impregnated carrier was dried at 120° C. for 3 hours, and then, calcined at 500° C. for one hour, thereby producing catalyst A. The amount of platinum loaded on the carrier was 0.8% by mass to the total amount of the carrier.

(Catalyst B)

USY zeolite (molar ratio of silica/alumina:37) having an average particle diameter of 1.1 μm, silica alumina (molar ratio of silica/alumina:14) and an alumina binder were mixed and kneaded at a weight ratio of 3:57:40, and the mixture was shaped into a cylindrical form having a diameter of about 1.6 mm and a length of about 4 mm. Then, this was calcined at 500° C. for one hour, thereby producing a carrier. The carrier was impregnated with a chloroplatinic acid aqueous solution to distribute platinum on the carrier. The impregnated carrier was dried at 120° C. for 3 hours, and then, calcined at 500° C. for one hour, thereby producing catalyst B. The amount of platinum loaded on the carrier was 0.8% by mass to the total amount of the carrier.

Example 1

Manufacture of Diesel Fuel Base Stock (Fractionation of FT Synthetic Oil)

In the first fractionator, oil produced by a FT synthesis method (i.e. FT synthetic oil) (the content of hydrocarbons having a boiling point of 150° C. or higher was 84% by mass, the content of hydrocarbons having a boiling point of 360° C. or higher was 42% by mass, and the content of hydrocarbons having 20 to 25 carbon atoms was 25.2% by mass, based on the total amount of the FT synthetic oil (corresponding to the sum of hydrocarbons having 5 or more carbon atoms)) was fractionated into a naphtha fraction having a boiling point of less than 150° C., a first middle fraction and a wax fraction where T90 of the first middle fraction became 360.0° C.

Table 1 shows T90 of the obtained first middle fraction, content of n-paraffins having 20 to 25 carbon atoms ($C_{20}$-$C_{25}$ n-paraffins) in the first middle fraction, and content of $C_{20}$-$C_{25}$ n-paraffins in the wax fraction.

In addition, the content (% by mass) of $C_{20}$-$C_{25}$ n-paraffins was obtained based on component analysis results of the components separated and quantitated by a gas chromatograph (SHIMADZU Corporation GC-2010) equipped with a nonpolar column (ultraalloy-1HT (30 m×0.25 mm ϕ), and a FID (hydrogen flame ionization detector); and using He as carrier gas and a predetermined temperature program. T90 was obtained in accordance with JIS K2254 "Petroleum products-Determination of distillation characteristics." Values were also calculated in Examples 2 to 4 and Comparative Example 1 by the above-mentioned method unless otherwise mentioned below.

(Hydroisomerization of First Middle Fraction)

The hydroisomerizing reactor 40, which is a fixed-bed flow reactor, was filled with the catalyst A (150 ml), the above-obtained middle fraction was supplied thereto from the tower apex of the hydroisomerizing reactor 40 at a rate of 225 ml/h, and the middle fraction was hydrogen-treated in a hydrogen stream under reaction conditions shown in Table 2.

That is, hydrogen was supplied from the tower apex at a hydrogen/oil ratio of 338 NL/L to the middle fraction, and the reactor pressure was adjusted with a back pressure valve, such that the inlet pressure remained constant at 3.0 MPa, and the hydroisomerization reaction was conducted. At that time, the reaction temperature was 308° C.

(Hydrocracking of Wax Fraction)

A reactor of the hydrocracking apparatus 50, which is a fixed-bed flow reactor, was filled with the catalyst A (150 ml), the above-obtained wax fraction was supplied thereto from the tower apex of the reactor of the hydrocracking apparatus 50 at a rate of 300 ml/h. Then, the wax fraction was hydrogen-treated in a hydrogen stream under reaction conditions shown in Table 2.

That is, hydrogen was supplied thereto from the tower apex at, a hydrogen/oil ratio of 667 NL/L for the wax fraction, and the reactor pressure was adjusted with a back pressure valve, such that the inlet pressure remained constant at 4.0 MPa, thereby hydrocracking the fraction. At that time, the reaction temperature was 329° C.

(Fractionation of Hydroisomerized Product and Hydrocracked Product)

The above-obtained hydroisomerized products of the middle fraction (isomerized middle fraction), and the above-obtained hydrocracked products of the wax fraction (wax-decomposition component) were line-blended at their respective yield coefficients, and the obtained mixture was fractionated such that T90 of the diesel fuel base stock obtained in the second fractionator 20 became 340.0° C. Then, the diesel fuel base stock was extracted therefrom, and stored in the tank 90A.

The bottom component in the second fractionator 20 is continuously delivered back to the line 14 that led to the hydrocracking apparatus 50 where hydrocracking was again performed.

A tower apex component in the second fractionator was extracted from the line 21, introduced into the extraction line 31 that extended from the hydro-refining apparatus 30, and the tower apex component was delivered to the stabilizer 60.

Table 3 shows yield coefficients and properties of the obtained diesel fuel base stock.

The content (% by mass) of n-paraffins having 19 or more carbon atoms ($C_{19}$), and T90 were measured according to the above-mentioned analysis method. The kinematic viscosity at 30° C. (kinematic viscosity@30° C.) was obtained in accordance with JIS K2283 "Crude oil and petroleum product—Determination of kinematic viscosity and calculation of viscosity index from kinematic viscosity," and a pour point was obtained in accordance with JIS K2269 "Testing method for Pour Point and Cloud Point of Crude Oil and Petroleum Products." Values were obtained in Examples 2 to 4 and Comparative Example 1 in the same manner unless otherwise mentioned below.

Example 2

Fractionation of FT Synthetic Oil

The same FT synthetic oil as in Example 1 was fractionated into a naphtha fraction having a boiling point of less than 150° C., a first middle fraction and a wax fraction in the first fractionator where T90 of the first middle fraction was 370.0° C.

Table 1 shows T90 of the obtained first middle fraction, content of n-paraffins having 20 to 25 carbon atoms ($C_{20}$ to $C_{25}$) in the first middle fraction, and content of $C_{20}$-$C_{25}$ n-paraffins in the wax fraction.

(Hydroisomerization of First Middle Fraction)

A fixed-bed flow reactor was filled with the catalyst A (150 ml), the above-obtained middle fraction was supplied thereto from the tower apex of the hydroisomerizing reactor 40 at a rate of 270 ml/h, and the middle fraction was hydrogen-treated in a hydrogen stream under reaction conditions shown in Table 2.

That is, hydrogen was supplied from the tower apex at a hydrogen/oil ratio of 338 NL/L to the middle fraction, the reactor pressure was adjusted with a back pressure valve, such that the inlet pressure remained constant at 3.0 MPa, thereby hydroisomerizing the middle fraction. At that time, the reaction temperature was 312° C.

(Hydrocracking of Wax Fraction)

A fixed-bed flow reactor of the reactor 50 was filled with the catalyst A (150 ml), the above-obtained wax fraction was supplied thereto from the tower apex of the reaction tower 50 at a rate of 255 ml/h, and the wax fraction was hydrogen-treated in a hydrogen stream under reaction conditions shown in Table 2.

That is, hydrogen was supplied from the tower apex at a hydrogen/oil ratio of 667 NL/L to the wax fraction, the reactor pressure was adjusted with a back pressure valve, such that the inlet pressure remained constant at 4.0 MPa, thereby hydrocracking the wax fraction. At that time, the reaction temperature was 323° C.

(Fractionation of Hydroisomerized Products and Hydrocracked Products)

The above-obtained hydroisomerized products of the middle fraction (isomerized middle fraction) and the above-obtained hydrocracked products of the wax fraction (wax-decomposition component) were line-blended at their respective yield coefficients, and the obtained mixture was fractionated such that T90 of the diesel fuel base stock obtained in the second fractionator 20 became 340.0° C., and then the diesel fuel base stock was extracted therefrom, and stored in the tank 90A.

The bottom fraction in the second fractionator 20 is continuously delivered back to the line 14 that led to the hydrocracking apparatus 50 where hydrocracking is again performed.

A tower apex component in the second fractionator was extracted from the line 21, introduced into the extraction line 31 that extended from the hydro-refining apparatus 30, and the tower apex component was delivered to the stabilizer 60.

Table 3 shows yield coefficients and properties of the obtained diesel fuel base stock.

Example 3

Fractionation of FT Synthetic Oil

The same FT synthetic oil as in Example 1 was fractionated into a naphtha fraction having a boiling point of less than 150° C., a first middle fraction and a wax fraction in the first fractionator such that T90 of the first middle fraction became 375.0° C.

Table 1 shows T90 of the obtained first middle fraction, content of n-paraffins having 20 to 25 carbon atoms ($C_{20}$ to $C_{25}$) in the first middle fraction, and content of $C_{20}$-$C_{25}$ n-paraffins in the wax fraction.

(Hydroisomerization of First Middle Fraction)

The hydroisomerizing reactor 40, which is a fixed-bed flow reactor, was filled with the catalyst A (150 ml), the above-obtained middle fraction was supplied thereto from the tower apex of the hydroisomerizing reaction tower 40 at a rate of 300 ml/h; and the middle fraction was hydrogen-treated in a hydrogen stream under reaction conditions shown in Table 2.

That is, hydrogen was supplied from the tower apex at a hydrogen/oil ratio of 338 NL/L to the middle fraction, the reactor pressure was adjusted with a back pressure valve, such that the inlet pressure remained constant at 3.0 MPa, thereby hydroisomerizing the middle fraction. At that time, the reaction temperature was 315° C.

(Hydrocracking of Wax Fraction)

A fixed-bed flow reactor of the reactor 50 was filled with the catalyst A (150 ml), the above-obtained wax fraction was supplied thereto from the tower apex of the reaction tower 50 at a rate of 255 ml/h, and the wax fraction was hydrogen-treated in a hydrogen stream under reaction conditions shown in Table 2.

That is, hydrogen was supplied from the tower apex at a hydrogen/oil ratio of 667 NL/L to the wax fraction, the reactor pressure was adjusted with a back pressure valve, such that the inlet pressure remained constant at 4.0 MPa, thereby hydrocracking the wax fraction. At that time, the reaction temperature was 319° C.

(Fractionation of Hydroisomerized Product and Hydrocracked Product)

The above-obtained hydroisomerized products of the middle fraction (isomerized middle fraction) and the above-obtained hydrocracked products of the wax fraction (wax-decomposition component) were line-blended at their respective yield coefficients, and the obtained mixture was fractionated such that T90 of the diesel fuel base stock obtained in the second fractionator 20 became 340.0° C., and then the diesel fuel base stock was extracted therefrom, and stored in the tank 90A.

The bottom fraction in the second fractionator 20 is continuously delivered back to the line 14 that led to the hydrocracking apparatus 50 where hydrocracking is again performed.

A tower apex component in the second fractionator was extracted from the line 21, introduced into the extraction line 31 that extended from the hydrofining apparatus 30, and the tower apex component was delivered to the stabilizer 60.

Table 3 shows yield coefficients and properties of the obtained diesel fuel base stock.

Comparative Example 1

Fractionation of FT Synthetic Oil

The same FT synthetic oil as in Example 1 was fractionated into a naphtha fraction having a boiling point of less than 150° C., a first middle fraction and a wax fraction in the first fractionator such that T90 of the first middle fraction became 340.0° C.

Table 1 shows T90 of the obtained first middle fraction, content of n-paraffin having 20 to 25 carbon atoms ($C_{20}$-$C_{25}$) in the first middle fraction, and content of $C_{20}$-$C_{25}$ n-paraffin in the wax fraction.

(Hydroisomerization of First Middle Fraction)

The hydroisomerizing reactor 40, which is a fixed-bed flow reactor, was filled with the catalyst A (150 ml), the above-obtained middle fraction was supplied thereto from the tower apex of the hydroisomerizing reaction tower 40 at a rate of 180 ml/h, and the middle fraction was hydrogen-treated in a hydrogen stream under reaction conditions shown in Table 2.

That is, hydrogen was supplied from the tower apex at a hydrogen/oil ratio of 338 NL/L to the middle fraction, the reactor pressure was adjusted with a back pressure valve, such that the inlet pressure remained constant at 3.0 MPa, thereby hydroisomerizing the middle fraction. At that time, the reaction temperature was 301° C.

(Hydrocracking of Wax Fraction)

A fixed-bed flow reactor of the reactor 50 was filled with the catalyst A (150 ml), the above-obtained wax fraction was supplied thereto from the tower apex of the reactor 50 at a rate of 345 ml/h, and the wax fraction was hydrogen-treated in a hydrogen stream under reaction conditions shown in Table 2.

That is, hydrogen was supplied from the tower apex at a hydrogen/oil ratio of 667 NL/L to the wax fraction, the reactor pressure was adjusted with a back pressure valve, such that the inlet pressure remained constant at 4.0 MPa, thereby hydrocracking the wax fraction. At that time, the reaction temperature was 335° C.

(Fractionation of Hydroisomerized Products and Hydrocracked Products)

The above-obtained hydroisomerized products of the middle fraction (isomerized middle fraction) and the above-obtained hydrocracked products of the wax fraction (wax-decomposition component) were line-blended at their respective yield coefficients, and the obtained mixture was fractionated such that T90 of the diesel fuel base stock obtained in the second fractionator 20 became 340.0° C., and then the diesel fuel base stock was extracted therefrom, and stored in the tank 90A.

The bottom component in the second fractionator 20 is continuously delivered back to the line 14 that led to the hydrocracking apparatus 50 where hydrocracking is again performed.

A tower apex component in the second fractionator was extracted from the line 21, introduced into the line 31 that extended from the hydrofining apparatus 30, and the tower apex component was delivered to the stabilizer 60.

Table 3 shows yield coefficients and properties of the obtained diesel fuel base stock.

TABLE 1

| | | Example 1 | Example 2 | Example 3 | Comparative Example 1 |
|---|---|---|---|---|---|
| First middle fraction | T90 (° C.) | 360.0 | 370.0 | 375.0 | 340.1 |
| | Content*[1] of $C_{20}$-$C_{25}$ n-paraffins (% by mass) | 15.0 | 23.2 | 25.1 | 2.1 |
| Wax fraction | Content*[1] of $C_{20}$-$C_{25}$ n-paraffins (% by mass) | 10.2 | 2.0 | 0.1 | 23.1 |

*[1]based on the total amount of FT synthetic oil (sum of hydrocarbons having 5 or more carbon atoms)

TABLE 2

| | | Example 1 | Example 2 | Example 3 | Comparative Example 1 |
|---|---|---|---|---|---|
| Conditions for hydroisomerization of first middle fraction | Catalyst | Catalyst A | Catalyst A | Catalyst A | Catalyst A |
| | LHSV ($h^{-1}$) | 1.5 | 1.8 | 2.0 | 1.2 |
| | Reaction temperature (° C.) | 308 | 312 | 315 | 301 |
| | Hydrogen partial pressure (MPa) | 3.0 | 3.0 | 3.0 | 3.0 |
| | Hydrogen/oil ratio (NL/L) | 338 | 338 | 338 | 338 |
| Conditions for hydrocracking of wax fraction | Catalyst | Catalyst B | Catalyst B | Catalyst B | Catalyst B |
| | LHSV ($h^{-1}$) | 2.0 | 1.7 | 1.5 | 2.3 |
| | Reaction temperature (° C.) | 329 | 323 | 319 | 335 |
| | Hydrogen partial pressure (MPa) | 4.0 | 4.0 | 4.0 | 4.0 |
| | Hydrogen/oil ratio (NL/L) | 667 | 667 | 667 | 667 |

TABLE 3

| | Example 1 | Example 2 | Example 3 | Comparative Example 1 |
|---|---|---|---|---|
| Difference between T90 of first middle fraction and T90 of diesel fuel base stock (° C.) | 20.0 | 30.0 | 35.0 | 0.0 |
| Yield coefficients*[1] of diesel fuel base stock (% by mass) | 57.0 | 57.0 | 57.0 | 57.0 |
| T90 (° C.) | 340.0 | 340.0 | 340.0 | 340.0 |
| Content*[2] of n-paraffins having 19 or more carbon atoms (% by mass) | 4.0 | 2.7 | 1.9 | 5.1 |
| Pour point (° C.) | −7.5 | −15.0 | −17.5 | −5.0 |
| Kinematic viscosity@30° C. ($mm^2/s$) | 2.5 | 2.5 | 2.5 | 2.5 |

*[1]based on the total amount of FT synthetic oil (sum of hydrocarbons having 5 or more carbon atoms)
*[2]based on diesel fuel base stock With regard to Examples 1 to 3, the first middle fraction was is subjected to crude extraction, and the amount of $C_{20}$-$C_{25}$ n-paraffin included in the first middle fraction was increased, thereby improving isomerization selectivity. Consequently, it was evident that low temperature performance of the obtained diesel fuel base stock was improved.

INDUSTRIAL APPLICABILITY

According to the method of manufacturing a diesel fuel base stock of the present invention, a diesel fuel base stock having excellent low temperature properties can be produced from FT synthetic oil. Therefore, a fuel produced from the diesel fuel base stock by the method of the present invention can be utilized under low temperature environments while diesel fuels produced by the prior arts cannot be utilized under such environments. Accordingly, the present invention has high applicability in industries including GTL (Gas to Liquid) and petroleum refinement.

The invention claimed is:

1. A method of manufacturing a diesel fuel base stock improved in low-temperature flowability, comprising:

(i) fractionating in a first fractionator a synthetic oil obtained by Fisher-Tropsch synthesis into at least two fractions of a first middle fraction containing a component having a boiling range corresponding to diesel fuel oil and containing a light wax component of n-paraffins having 20 to 25 carbon atoms, and a wax fraction containing a wax component heavier than the first middle fraction;

(ii) hydroisomerizing the first middle fraction by bringing the first middle fraction into contact with a hydroisomerizing catalyst to produce a hydroisomerized middle fraction;

(iii) hydrocracking the wax fraction by bringing the wax fraction into contact with a hydrocracking catalyst to produce a wax-decomposition component; and (iv) fractionating in a second fractionator a mixture of the produced hydroisomerized middle fraction and the produced wax-decomposition component, wherein rectification conditions in the first fractionator and/or rectification conditions in the second fractionator are adjusted to reduce the content of n-paraffin having 19 or more carbon atoms in a heavy component contained in the diesel fuel base stock, and wherein the fractionation is conducted where the 90% by volume distillation temperature of the first middle fraction, which is a feedstock for the hydroisomerization, is higher than the 90% by volume distillation temperature of the diesel fuel base stock by 20° C. or more as one of the rectification conditions in the first fractionator.

2. The method of manufacturing a diesel fuel base stock according to claim 1, wherein: the 90% by volume distillation temperature of the first middle fraction, which is a feedstock for the hydroisomerization, is 360° C. or higher, and the 90% by volume distillation temperature of the diesel fuel base stock is 340° C. or less.

3. The method of manufacturing a diesel fuel base stock according to claim 1, wherein:

when bringing the first middle fraction into contact with the hydroisomerizing catalyst, the reaction temperature is 180° C. to 400° C., the hydrogen partial pressure is 0.5 MPa to 12 MPa, and the liquid hourly space velocity is 0.1 $h^{-1}$ to 10.0 $h^{-1}$; and, when bringing the wax fraction into contact with the hydrocracking catalyst, the reaction temperature is 180° C. to 400° C., the hydrogen partial pressure is 0.5 MPa to 12 MPa, and the liquid hourly space velocity is 0.1 $h^{-1}$ to 10.0 $h^{-1}$.

* * * * *

UNITED STATES PATENT AND TRADEMARK OFFICE

CERTIFICATE OF CORRECTION

PATENT NO. : 8,597,502 B2
APPLICATION NO. : 12/733918
DATED : December 3, 2013
INVENTOR(S) : Yuichi Tanaka et al.

It is certified that error appears in the above-identified patent and that said Letters Patent is hereby corrected as shown below:

In the Specification

Column 10, line 54, change "3.5 $h^{1}$" to -- 3.5 $h^{-1}$ --.

Signed and Sealed this
Twelfth Day of August, 2014

Michelle K. Lee

Michelle K. Lee
*Deputy Director of the United States Patent and Trademark Office*